US007489079B2

(12) United States Patent
Fujitani

(10) Patent No.: US 7,489,079 B2
(45) Date of Patent: Feb. 10, 2009

(54) PLASMA DISPLAY HAVING A RECESSED PART IN A DISCHARGE CELL

(75) Inventor: Morio Fujitani, Osaka (JP)

(73) Assignee: Panasonic Corporation, Osaka (JP)

( * ) Notice: Subject to any disclaimer, the term of this patent is extended or adjusted under 35 U.S.C. 154(b) by 131 days.

(21) Appl. No.: 10/477,185

(22) PCT Filed: Mar. 5, 2003

(86) PCT No.: PCT/JP03/02573

§ 371 (c)(1),
(2), (4) Date: Nov. 10, 2003

(87) PCT Pub. No.: WO03/075301

PCT Pub. Date: Sep. 12, 2003

(65) Prior Publication Data

US 2004/0174119 A1 Sep. 9, 2004

(30) Foreign Application Priority Data

Mar. 6, 2002 (JP) ..... 2002-059928

(51) Int. Cl.
*H01J 17/49* (2006.01)

(52) U.S. Cl. ..... 313/586; 313/582; 313/584; 313/585; 313/587; 315/169.3; 315/169.4

(58) Field of Classification Search ..... 313/586
See application file for complete search history.

(56) References Cited

U.S. PATENT DOCUMENTS 5,548,186 A 8/1996 Ota
5,742,122 A 4/1998 Amemiya et al. ..... 313/582
5,977,708 A * 11/1999 Amatsu et al. ..... 313/586
6,097,149 A 8/2000 Miyaji et al. ..... 313/582
6,200,182 B1 3/2001 Nanto et al.

(Continued)

FOREIGN PATENT DOCUMENTS

EP 0 788 131 8/1997

(Continued)

OTHER PUBLICATIONS

Supplementary European Search Report issued May 29, 2008 in European Application No. 03 74 3611.

*Primary Examiner*—Sikha Roy
(74) *Attorney, Agent, or Firm*—Wenderoth, Lind & Ponack, L.L.P.

(57) ABSTRACT

A plasma display device is provided having improved efficiency and increased image quality. This device includes a pair of front and back substrates opposed to each other to form between the substrates a discharge space partitioned by barrier ribs, a plurality of display electrodes, each of which is formed of a scan electrode and a sustain electrode and disposed on the substrate of a front panel to form a discharge cell between the barrier ribs, a dielectric layer formed above the front substrate to cover the display electrodes, and a phosphor layer which emits light by discharge between the display electrodes. The dielectric layer is constructed of at least two layers of different softening points and is formed with, at its surface closer to the discharge space, a recessed part in each discharge cell. This suppresses extension of the discharge and allows stable formation of the recessed part.

6 Claims, 5 Drawing Sheets

U.S. PATENT DOCUMENTS

| | | | | |
|---|---|---|---|---|
| 6,215,246 | B1 * | 4/2001 | Kim et al. | 313/584 |
| 6,255,780 | B1 | 7/2001 | Komaki et al. | 313/586 |
| 6,525,470 | B1 * | 2/2003 | Amemiya | 313/586 |
| 6,531,820 | B1 * | 3/2003 | Lee et al. | 313/586 |
| 6,853,138 | B1 * | 2/2005 | Park et al. | 313/586 |
| 6,897,610 | B1 | 5/2005 | Aoki et al. | |
| 7,038,382 | B2 * | 5/2006 | Hashikawa et al. | 313/582 |
| 2002/0024303 | A1 | 2/2002 | Sano et al. | |
| 2004/0174120 | A1 * | 9/2004 | Fujitani | 313/586 |

FOREIGN PATENT DOCUMENTS

| | | | |
|---|---|---|---|
| EP | 1 041 600 | | 10/2000 |
| EP | 1 093 147 | | 4/2001 |
| JP | 5-41167 | | 2/1993 |
| JP | 7-105855 | | 4/1995 |
| JP | 8-250029 | | 9/1996 |
| JP | 11-96919 | | 4/1999 |
| JP | 2000-156168 | | 6/2000 |
| JP | 2000-315459 | | 11/2000 |
| JP | 2001-357784 | | 12/2001 |
| JP | 2001357784 | A * | 12/2001 |
| JP | 2002-25450 | | 1/2002 |
| WO | 00/45412 | | 8/2000 |

* cited by examiner

FIG. 5 PRIOR ART

PLASMA DISPLAY HAVING A RECESSED PART IN A DISCHARGE CELL

TECHNICAL FIELD

The present invention relates to a plasma display device, utilizing light emission from gas discharge, and which is used in a color television receiver for character or image display, a display or the like.

BACKGROUND ART

Recently, expectations have run high for large-screen, wall-hung televisions as interactive information terminals. There are many display devices for those terminals, including a liquid crystal display panel, a field emission display and an electroluminescent display, and some of these devices are commercially available, while the others are under development. Of these display devices, a plasma display panel (hereinafter referred to as "PDP"or "panel") is a self-emissive type and is capable of beautiful image display. Because the PDP can easily have, for example, a large screen, the display using the PDP has received attention as a thin display device affording excellent visibility and has increasingly high definition and an increasingly large screen.

The PDP is classified as an AC or DC type according to its driving method and classified as a surface discharge type or an opposing discharge type according to its discharge form. In terms of high definition, large screen size and facilitation of production, the surface discharge AC type PDP has become mainstream under present conditions.

FIG. 5 is a perspective view illustrating the structure of a panel of a conventional plasma display device. As shown in FIG. 5, this PDP is constructed of front panel 1 and back panel 2. Front panel 1 is constructed by forming a plurality of stripe-shaped display electrodes 6 each formed of a pair of scan electrode 4 and sustain electrode 5 on transparent front substrate 3 such as a glass substrate made of, for example, borosilicate sodium glass by a float process, covering display electrodes 6 with dielectric layer 7, and forming protective film 8 made of MgO over dielectric layer 7. Scan electrode 4 and sustain electrode 5 are formed of respective transparent electrodes 4*a*, 5*a* and respective bus electrodes 4*b*, 5*b*, formed of Cr—Cu—Cr, Ag or the like, and which are electrically connected to respective transparent electrodes 4*a*, 5*a*. A plurality of black stripes or light-shielding films (not shown) are formed between display electrodes 6 and are parallel to display electrodes 6.

Back panel 2 has the following structure. On back substrate 9, which is disposed to face front substrate 3, address electrodes 10 are formed in a direction orthogonal to display electrodes 6 and are covered with dielectric layer 11. A plurality of stripe-shaped barrier ribs 12 are formed parallel to address electrodes 10 on dielectric layer 11 with each barrier rib 12 located between adjacent address electrodes 10, and phosphor layer 13 is formed to cover a side of each barrier rib 12 and dielectric layer 11. Typically, red, green and blue phosphor layers 13 are successively deposited for display in color.

Substrates 3, 9 of front and back panels 1, 2 are opposed to each other across a minute discharge space with display electrodes 6 orthogonal to address electrodes 10, and their periphery is sealed with a sealing member. The discharge space is filled with discharge gas, which is made by mixing, for example, neon (Ne) and xenon (Xe), at a pressure of about 66,500 Pa (500 Torr).

In this way, the PDP is formed. The discharge space of this PDP is partitioned into a plurality of sections by barrier ribs 12, and a plurality of discharge cells or light-emitting pixel regions are defined by barrier ribs 12 and display and address electrodes 6, 10 that are orthogonal to each other.

FIG. 6 is a plan view illustrating the discharge cells of the conventional PDP. As shown in FIG. 6, scan and sustain electrodes 4, 5 of display electrode 6 are disposed with discharging gap 14 between these electrodes 4, 5. Light-emitting pixel region 15 is a region surrounded by this display electrode 6 and barrier ribs 12, and non-light-emitting pixel region 16 is an adjoining gap or region between adjacent display electrodes 6.

With this PDP, discharge is caused by periodic application of voltage to address electrode 10 and display electrode 6, and ultraviolet rays generated by this discharge are applied to phosphor layer 13, thereby being converted into visible light. In this way, an image is displayed.

For development of the PDP, higher luminance, higher efficiency, lower power consumption and lower cost are essential. To achieve higher efficiency, discharge in the part shielded from the frontward light needs to be minimized by controlling the discharge. For example, Japanese Patent Unexamined Publication No. H8-250029 discloses a method for improving the efficiency. According to this known method, light emission in a part masked by a metal row electrode is suppressed by increasing the thickness of a dielectric layer above this metal row electrode.

The above-described conventional structure, however, has the following problem. Although light emission in a direction perpendicular to the electrode is suppressed, discharge in a direction parallel to the electrode is not suppressed, but extends to the neighborhood of the barrier ribs, which lower electron temperature accordingly. This results in reduced efficiency. To change the thickness of some parts of the dielectric layer, recessed parts are formed by the following method. The dielectric layer is formed out of, for example, two layers. After the lower layer is formed, the upper layer having holes is stacked on the lower layer. This method, however, has the following problem. If the upper dielectric layer has the same firing temperature as the lower dielectric layer, the lower dielectric layer softens during firing of the upper dielectric layer, thus causing the shape of the hole of the upper dielectric layer to become hard to maintain. This results in the recessed part of the dielectric layer having a deteriorated shape.

The present invention addresses such problems and aims to improve the efficiency and to allow stable formation of a recessed part or the like in a dielectric layer while providing a good yield.

SUMMARY OF THE INVENTION

To attain the objects discussed above, a plasma display device of the present invention includes a pair of front and back substrates opposed to each other to form between the substrates a discharge space partitioned by a barrier rib, a plurality of display electrodes each disposed on the front substrate to form a discharge cell between the barrier ribs, a dielectric layer formed above the front substrate to cover the display electrodes and a phosphor layer which emits light by discharge between the display electrodes. The dielectric layer is constructed of at least two layers of different softening points and is formed with, at a surface thereof closer to the discharge space, a recessed part in each of the discharge cells.

This structure allows highly efficient discharge by controlling extension of the discharge to a region where frontward light transmission is suppressed and also allows stable formation of the recessed part, which suppresses the extension of the discharge, in the dielectric layer while providing a good yield.

DETAILED DESCRIPTION OF THE PREFERRED EMBODIMENT

Referring to FIGS. 1-4, a description will be provided herein after of a plasma display device in accordance with an exemplary embodiment of the present invention.

Figure 1:
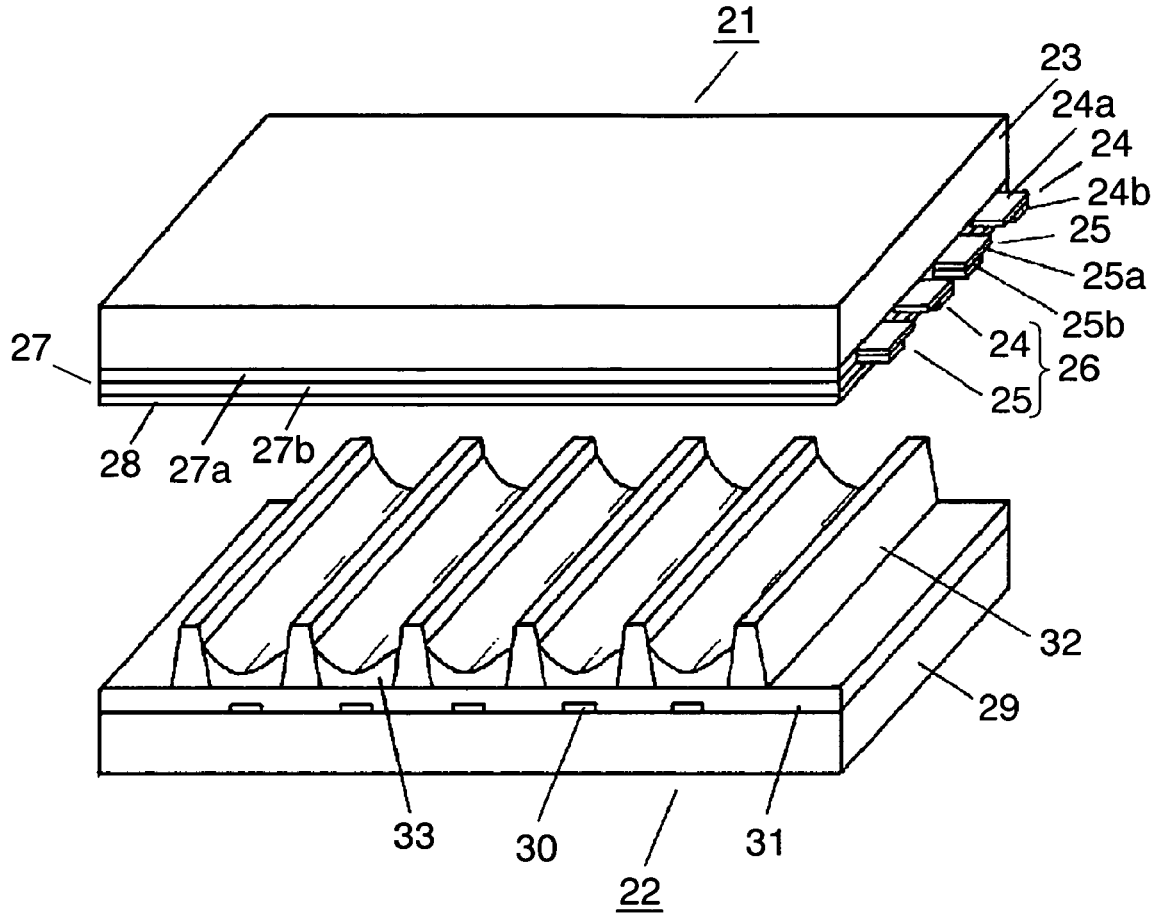
FIG. 1 is a perspective view illustrating the structure of a panel of a plasma display device in accordance with an exemplary embodiment of the present invention.

FIG. 1 illustrates an example of the structure of a PDP used in the plasma display device in accordance with the present embodiment. As shown in FIG. 1, the PDP is constructed of front panel 21 and back panel 22.

Front panel 21 is constructed by forming a plurality of stripe-shaped display electrodes 26 each formed of a pair of scan electrode 24 and sustain electrode 25 on transparent front substrate 23 such as a glass substrate made of, for example, borosilicate sodium glass by a float process, covering display electrodes 26 with dielectric layer 27, and forming protective film 28 made of Front panel 21 is constructed by forming a plurality of stripe-shaped display electrodes 26 each formed of a pair of scan electrode 24 and sustain electrode 25 on transparent front substrate 23 such as a glass substrate made of, for example, borosilicate sodium glass by a float process, covering display electrodes 26 with dielectric layer 27, and forming protective film 28 made of MgO over dielectric layer 27. Dielectric layer 27 includes, for example, two dielectric layers 27*a*, 27*b*. Scan electrode 24 and sustain electrode 25 are formed of respective transparent electrodes 24*a*, 25*a* and respective bus electrodes 24*b*, 25*b*, formed of Cr—Cu—Cr, Ag or the like, and which are electrically connected to respective transparent electrodes 24*a*, 25*a*. A plurality of black stripes or light-shielding films (not shown) are formed between display electrodes 26 and are parallel to display electrodes 26.

Back panel 22 has the following structure. On back substrate 29, which is disposed to face front substrate 23, address electrodes 30 are formed in a direction orthogonal to display electrodes 26 and are covered with dielectric layer 31. A plurality of stripe-shaped barrier ribs 32 are formed parallel to address electrodes 30 on dielectric layer 31 and are located between address electrodes 30. Phosphor layer 33 is formed between barrier ribs 32 to cover a side of each barrier rib 32 and dielectric layer 31. Typically, red, green and blue phosphor layers 33 are successively deposited for display in color.

Substrates 23, 29 of front and back panels 21, 22 are opposed to each other across a minute discharge space with display electrodes 26 orthogonal to address electrodes 30, and their periphery is sealed with a sealing member. The discharge space is filled with discharge gas, which is made by mixing, for example, neon (Ne) and xenon (Xe), at a pressure of about 66,500 Pa (500 Torr). In this way, the PDP is formed.

The discharge space of this PDP is partitioned into a plurality of sections by barrier ribs 32, and display electrodes 26 are provided to define a plurality of discharge cells or light-emitting pixel regions between barrier ribs 32. Display electrodes 26 are disposed orthogonal to address electrodes 30.

Figure 2:
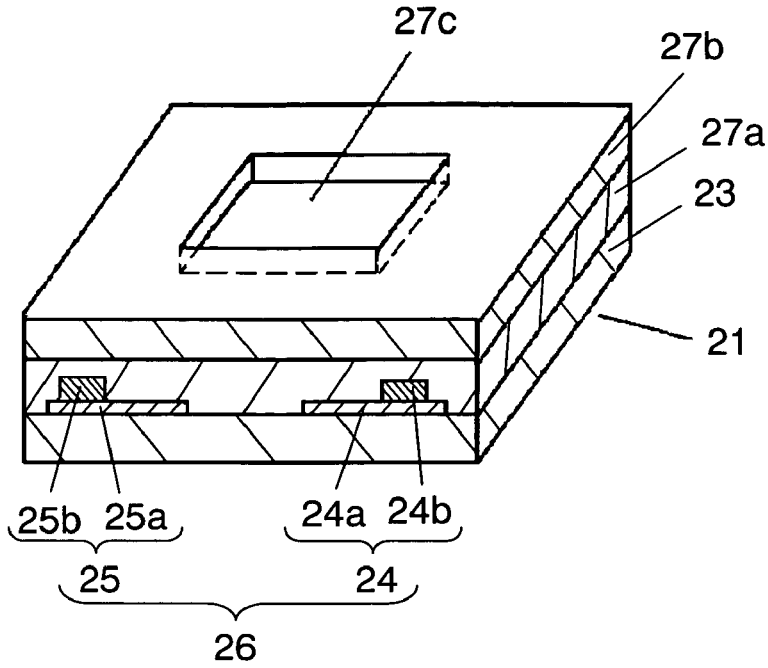
FIG. 2 is a perspective view illustrating the structure of a part corresponding to a discharge cell in the panel of the same plasma display device.
Figure 3:
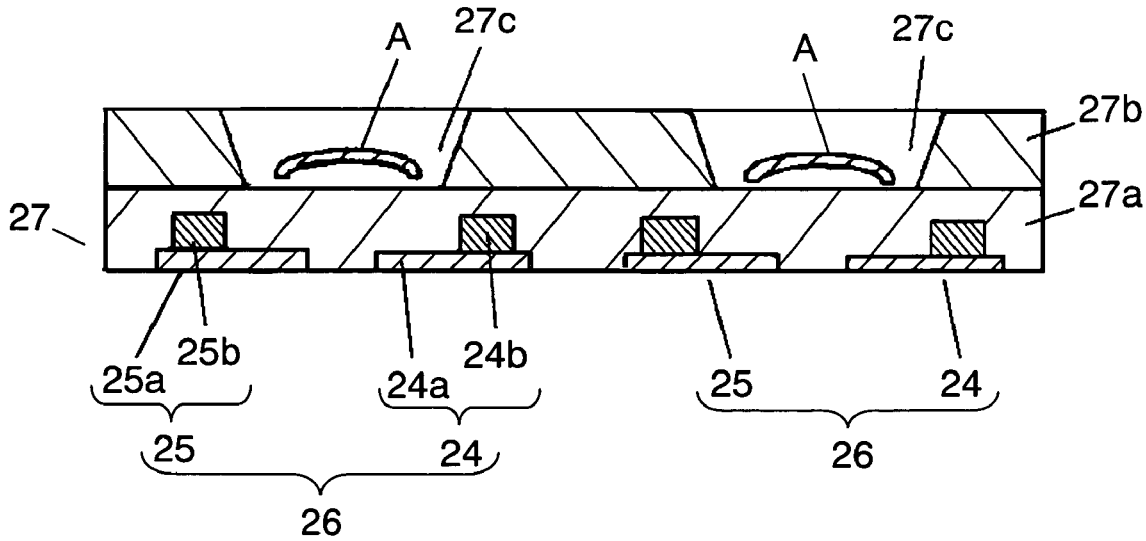
FIG. 3 is a schematic view illustrating an effect of the same plasma display device.

FIGS. 2 and 3 are enlarged views illustrating a part of front panel 21 that corresponds to one discharge cell. As shown in FIGS. 2 and 3, dielectric layer 27 is formed of lower dielectric layer 27*a* formed on front substrate 23 to cover display electrodes 26, and upper dielectric layer 27*b*, formed to cover lower dielectric layer 27*a*, and which is closer to the discharge space. These lower and upper dielectric layers 27*a*, 27*b* have different softening points. Upper dielectric layer 27*b* of dielectric layer 27 is formed with, at its surface, recessed part 27*c* in each discharge cell. This recessed part 27*c* is formed by hollowing out only upper dielectric layer 27*b* in each discharge cell and may be formed so that its bottom is defined by lower dielectric layer 27*a*. Preferably, upper dielectric layer 27*b* is formed to have a lower softening point than that of lower dielectric layer 27*a*. Recessed part 27*c* formed is located inside of barrier ribs 32 (FIG. 1). For example, recessed part 27*c* is located at least 20μm away from barrier ribs 32 (FIG. 1).

Dielectric layer 27 is a glass fired body (dielectric layer) obtained by firing and includes glass powder such as a mixture including $ZnO—B_2O_3—SiO_2$, a mixture including $PbO—B_2O_3—SiO_2$, a mixture including $PbO—B_2O_3—SiO_2—Al_2O_3$, a mixture including $PbO—ZnO—B_2O_3—SiO_2$ or a mixture including $Bi_2O_3—B_2O_3—SiO_2$.

The softening point of upper dielectric layer 27*b* is preferably lower than that of lower dielectric layer 27*a* and higher than temperatures for formation of protective film 28, sealing and exhaust baking, which are carried out after formation of upper dielectric layer 27*b*, in order to prevent upper dielectric layer 27*b* from softening again in these subsequent heat processes.

In cases where the temperatures for formation of protective film 28, sealing and exhaust baking are as high as 500° C., the softening point of upper dielectric layer 27*b* needs to be higher than 500° C. In this case, the softening point of lower dielectric layer 27*a* is set at, for example, 570 to 600° C., while the softening point of upper dielectric layer 27*b* is set at, for example, 540° C. to 570° C. The softening point is adjusted by changing the proportion of PbO or $SiO_2$ in the composition. Generally, the softening point lowers if the proportion of PbO in the composition is increased or if the proportion of $SiO_2$ in the composition is decreased. The glass powder having a softening point of about 600° C. includes a composition including 45 wt % to 65 wt % of lead oxide (PbO), 10 wt % to 30 wt % of boron oxide ($B_2O_3$), 10 wt % to 30 wt % of silicon oxide ($SiO_2$) and an additive including 1 wt % to 10 wt % of calcium oxide (CaO) and 0 wt % to 3 wt % of aluminum oxide ($Al_2O_3$) per 100 wt % of the composition. A 5-10% decrease in the weight percentage of PbO can result in a 30° C. decrease in the softening point.

In cases where the temperatures for formation of protective film 28, sealing and exhaust baking are about 400° C., the softening point of upper dielectric layer 27*b* may be equal to or higher than 400° C. Accordingly, an increased difference can be obtained between the softening points of upper and lower dielectric layers 27*b*, 27*a*, thus being advantageous in bringing about an advantage of the present invention. In this case, the softening point of upper dielectric layer 27*b* is set at, for example, 400° C. to 500° C., while the softening point of lower dielectric layer 27*a* is set at, for example, 500° C. to 600° C. The glass powder having a softening point of 400° C. to 500° C. can be prepared by increasing the proportion of PbO or decreasing the proportion of $SiO_2$ in the composition, and such glass powder includes a composition including 55 wt % to 85 wt % of lead oxide (PbO), 10 wt % to 30 wt % of boron oxide ($B_2O_3$), 1 wt % to 20 wt % of silicon oxide ($SiO_2$) and an additive including 1 wt % to 10 wt % of calcium oxide (CaO) and 0 wt % to 3 wt % of aluminum oxide ($Al_2O_3$) per 100 wt % of the composition. On the other hand, the glass powder having a softening point of 500° C. to 600° C. can be prepared by decreasing the proportion of PbO or increasing the proportion of $SiO_2$ in the composition, and such glass powder includes a composition including 45 wt % to 65 wt % of lead oxide (PbO), 10 wt % to 30 wt % of boron oxide ($B_2O_3$), 10 wt % to 30 wt % of silicon oxide ($SiO_2$) and an additive including 1 wt % to 10 wt % of calcium oxide (CaO) and 0 wt % to 3 wt % of aluminum oxide ($Al_2O_3$) per 100 wt % of the composition. In the present invention, such glass powders of different softening points are used to form the dielectric layers of different softening points.

According to the present invention, dielectric layer 27 is formed with, at its surface closer to the discharge space, recessed part 27*c* in each discharge cell defining the light-emitting pixel region. FIG. 3 is a schematic view illustrating an effect of the plasma display device of this invention. The bottom of recessed part 27*c* where the thickness of dielectric layer 27 is reduced as shown in FIG. 3 has increased capacitance, so that charges for discharge concentrate on the bottom of recessed part 27*c* during their formation. Accordingly, a discharge region can be limited as illustrated by A of FIG. 3.

Figure 4:
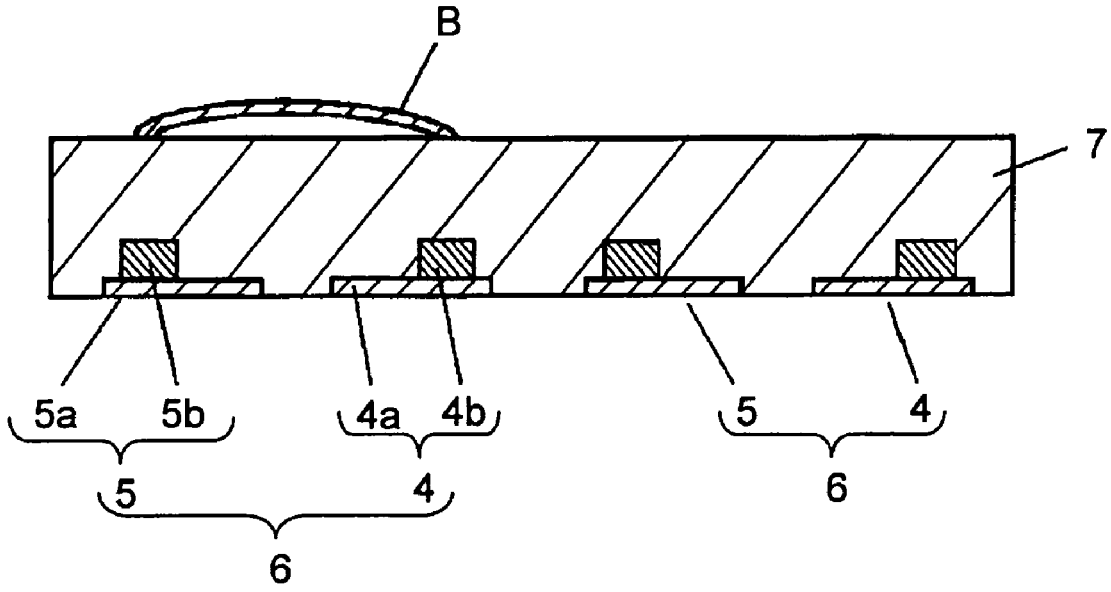
FIG. 4 PRIOR ART
FIG. 4 is a schematic view illustrating discharge of a conventional plasma display device.
Figure 5:
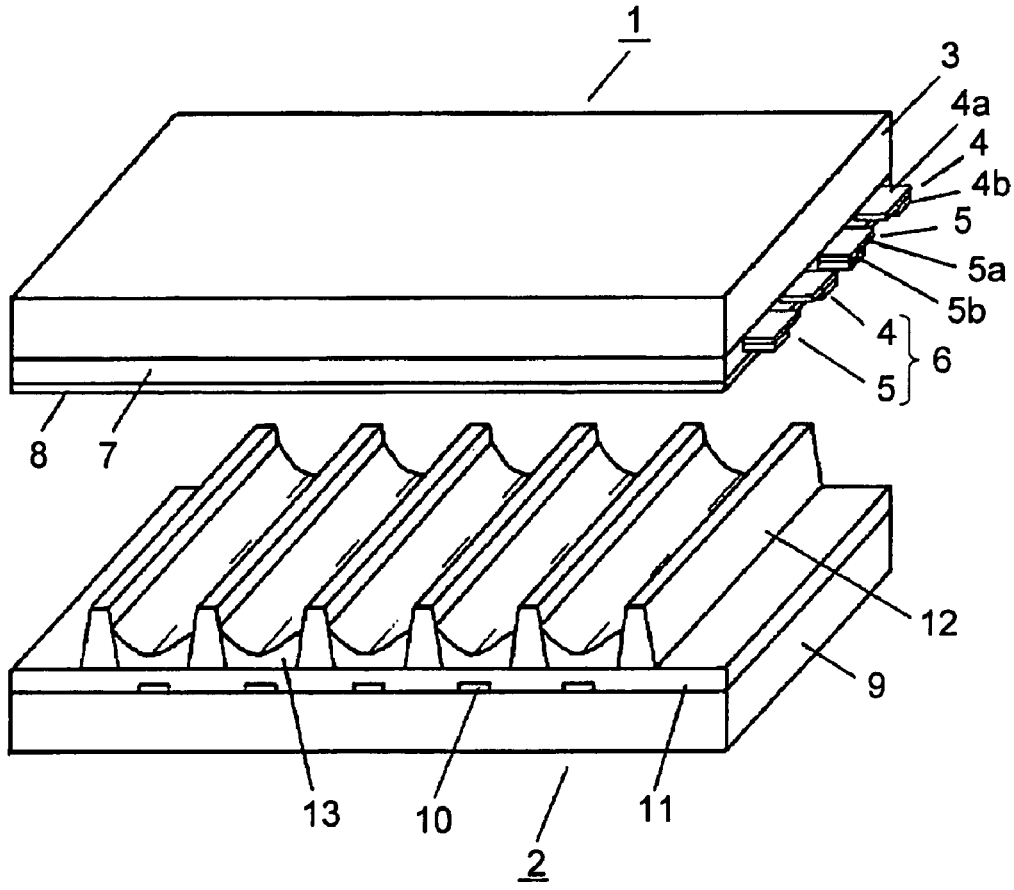
FIG. 5 is a perspective view illustrating the structure of a panel of a conventional plasma display device.
Figure 6:
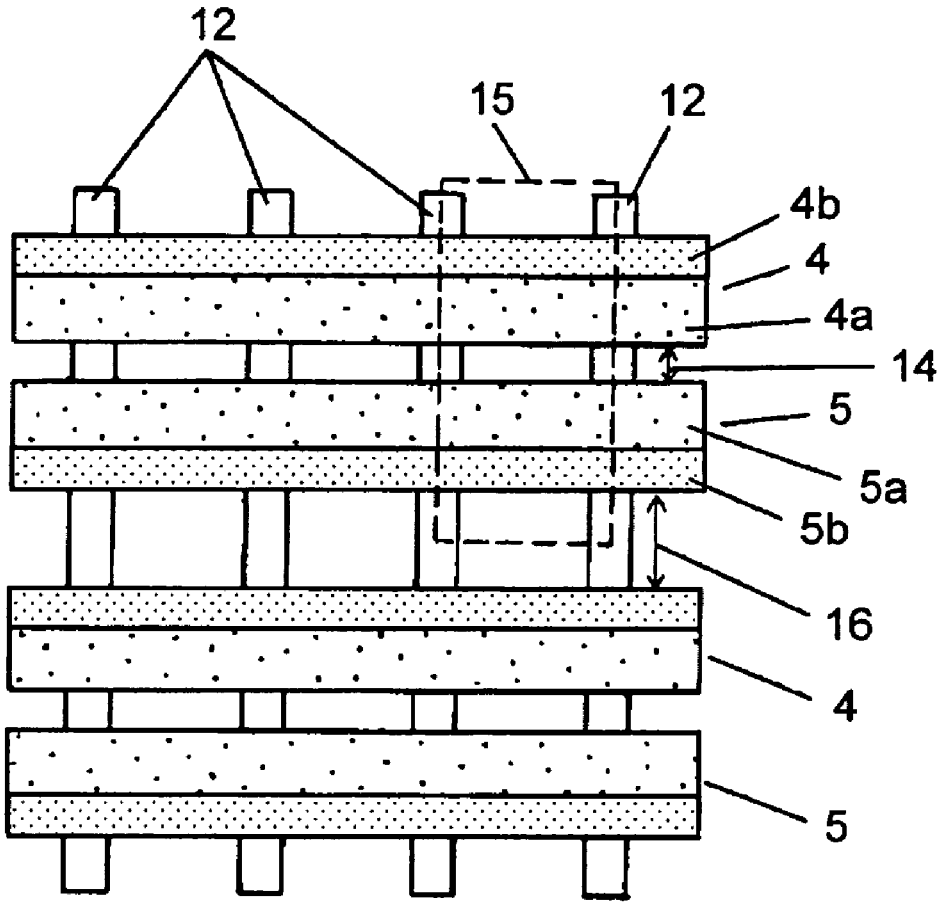
FIG. 6 PRIOR ART
FIG. 6 is a plan view illustrating the structure of discharge cells of the conventional plasma display device.

FIG. 4 is a schematic view illustrating discharge of a conventional plasma display device. In the conventional structure having no recessed part as shown in FIG. 4, dielectric layer 7 has uniform thickness, thereby having uniform capacitance at its surface. Accordingly, discharge, as denoted by B, extends to the neighborhood of electrodes, causing a phosphor corresponding to a part shielded from frontward light to emit the light. This results in reduced efficiency. There are also cases where undesirable discharge easily occurs between the cell and its adjacent cell because charges are formed even in a portion close to the adjacent cell.

A method for forming recessed parts 27*c* in dielectric layer 27 is as follows. Dielectric layer 27 is formed of, for example, the two layers, that is, lower dielectric layer 27*a* and upper dielectric layer 27*b*. After lower dielectric layer 27*a* is formed, upper dielectric layer 27*b* having holes is stacked on lower dielectric layer 27*a*. If upper dielectric layer 27*b* has, in this case, the same firing temperature as lower dielectric layer 27*a*, lower dielectric layer 27*a* softens again during firing of upper dielectric layer 27*b*, thus causing the shape of the hole of upper dielectric layer 27*b* to become hard to keep. This results in recessed part 27*c* of dielectric layer 27 having a deteriorated shape.

The present invention, however, allows formation of recessed part 27*c* having a stable shape, without causing lower dielectric layer 27*a* to soften again in a process of applying, drying and firing upper dielectric layer 27*b* after lower dielectric layer 27*a* is fired. This is because the softening point of upper dielectric layer 27*b* closer to the discharge space is set lower than that of lower dielectric layer 27*a* covering the display electrodes.

To achieve higher efficiency of the PDP, discharge in a part shielded from frontward light needs to be minimized by controlling the discharge. For example, Japanese Patent Unexamined Publication No. H8-250029 discloses a method for improving the efficiency. According to this known method, light emission in a part masked by a metal row electrode is suppressed by increasing the thickness of a dielectric above this metal row electrode. With this conventional structure, although light emission in a direction perpendicular to the electrode is suppressed, discharge in a direction parallel to the electrode is not suppressed, but extends to the neighborhood of the barrier ribs, which lower electron temperature accordingly. This may result in reduced efficiency. Moreover, it is known that if the discharge is carried out in the vicinity of the barrier ribs, the barrier ribs become negatively charged and attract positive ions accordingly. Consequently, the barrier ribs are etched by ionic bombardment. As a result of etching, some portions of the barrier ribs, for example, accumulate on the phosphor layer and may thus degrade a characteristic.

The present invention can limit the discharge only to the bottom of recessed part 27*c* by forming recessed part 27*c* in each discharge cell and locating each recessed part 27*c* inside of barrier ribs 32. Consequently, the discharge can be suppressed in the vicinity of barrier ribs 32.

In the present invention, upper dielectric layer 27*b* where the non-light-emitting region is covered and the thickness of dielectric layer 27 increases has a smaller dielectric constant than that of lower dielectric layer 27*a*, so that this non-light-emitting region can have reduced capacitance. Consequently, charges to be stored in this region can be suppressed. Reducing the capacitance also raises breakdown voltage in this region, thus suppressing the discharge in this region further. In other words, the discharge is limited to the bottom of recessed part 27*c*, whereby crosstalk between the adjacent cells can be suppressed substantially.

Instead of having the shape described above, recessed part 27*c* may be shaped into one of those applicable to the present invention, such as a cylinder, a cone, a triangular prism and a triangular pyramid, and is not limited to the present embodiment.

A description will be provided next of a method of manufacturing the PDP.

First, on the glass substrate, which becomes front substrate 23 of front panel 21, a film of transparent electrode material, such as ITO or $SnO_2$, for scan and sustain electrodes 24, 25 is formed by sputtering to have a uniform thickness of about 100 nm. Next, a positive type resist mainly including novolak resin is applied to this transparent electrode material film to a thickness of 1.5 to 2.0 μm and then cured by being exposed to ultraviolet rays via a dry plate having a desired pattern. Thereafter, using an alkaline aqueous solution, development is done to form a resist pattern. Subsequently, the substrate is immersed in a solution mainly including hydrochloric acid for etching, whereby an unnecessary part is removed, and finally, the resist is removed. In this way, the transparent electrodes are formed.

Next, bus electrodes 24*b*, 25*b* are formed. In this process, an electrode material film is formed. This electrode material film is formed of a film of black electrode material, which includes black pigment including $RuO_2$ and glass frit (including PbO—$B_2O_3$—$SiO_2$ or $Bi_2O_3$—$B_2O_3$—$SiO_2$), and a film of metal electrode material, which includes conductive material such as Ag and glass frit (including PbO—$B_2O_3$—$SiO_2$ or $Bi_2O_3$—$B_2O_3$—$SiO_2$). After the electrode material film is dried, this electrode material film is irradiated with ultraviolet rays via a dry plate having a desired pattern to have an exposed part cured and then undergoes development using an alkaline developer (aqueous solution including 0.3 wt % of sodium carbonate) to form a desired pattern. Subsequently, firing is carried out in the air at a temperature equal to or higher than a softening point of the glass material to fix bus electrodes 24*a*, 25*a* to the respective transparent electrodes for scan and sustain electrodes 24, 25. In this way, the bus electrodes are formed on the respective transparent electrodes, thus completing display electrodes 26 of front panel 21.

Next, dielectric layer 27 is formed. In this process, a paste-like composition (glass paste composition) including glass powder, binding resin and a solvent is applied to the surface of the glass substrate formed with display electrodes 26 by, for example, a die coating method. This composition applied is dried and then fired, thus forming dielectric layer 27 on the surface of the glass substrate. The two dielectric layers may be formed of film-forming material layers (sheet-like dielectric materials), which are formed by applying the glass paste composition to supporting films and drying this composition. In this case, the cover film is removed from the sheet-like dielectric material for dielectric layer 27, which is then overlaid with the other sheet-like dielectric material so that its surface contacts the glass substrate. Using a heating roller, press-bonding is subsequently performed on the sheet-like dielectric materials from above the other supporting film, whereby the sheet-like dielectric materials are fixed above the glass substrate. Thereafter, the supporting film is removed from the sheet-like dielectric material fixed above the glass substrate. Instead of the heating roller, a roller that does not heat may be used for press-bonding. A method for forming recessed part 27*c* in the surface of dielectric layer 27 that is closer to the discharge space is as follows. Dielectric layer 27 is formed of, for example, the two layers. After lower dielectric layer 27*a* is formed, a photosensitive glass paste composition for upper dielectric layer 27*b* that is made by adding photosensitive material to the glass paste composition is applied to lower dielectric layer 27*a* and undergoes exposure and development, thereby to have the holes. Thereafter, firing is done. In this way, dielectric layer 27 has the holes. The glass powders included in respective upper and lower dielectric layers 27*a*, 27*b* have different softening points to prevent lower dielectric layer 27*a* from softening during firing of upper dielectric layer 27*b*.

Next, protective film 28 is formed. In this process, protective film 28 made of MgO (magnesium oxide) is formed over dielectric layer 27 by electron beam evaporation to have a uniform thickness of about 600 nm. Thus-obtained front panel 21 of the PDP includes dielectric layer 27 having a desired three-dimensional structure having upper and lower dielectric layers 27*a*, 27*b* of different softening points.

Back panel 22 of the PDP is manufactured in the following manner. As is the case with bus electrodes 24*b*, 25*b* of front panel 21, address electrodes 30 are formed on a glass substrate, made by the float process, and which becomes substrate 29 of back panel 22. As in the case of front panel 21, these electrodes 30 are covered with dielectric layer 31, and barrier ribs 32 are formed on this dielectric layer 31.

Material for dielectric layer 31 includes a paste-like composition (glass paste composition) prepared to include glass powder, binding resin and a solvent. This glass paste composition is applied to a supporting film and then dried to form a film-forming material layer. As in the case of front panel 21, the film-forming material layer formed on the supporting film is fixed to the glass substrate formed with address electrodes 30 by transfer and thereafter fired. In this way, dielectric layer 31 can be formed on the glass substrate. Similarly, this material and transfer can be used for formation of a film-forming material layer for barrier ribs 32.

Methods of patterning into barrier ribs 32 include photolithography and sandblasting.

Next, phosphors having respective colors of R, G and B are applied and fired, thereby forming phosphor layers 33 each located between barrier ribs 32. In this way, back panel 22 can be obtained.

Front and back panels 21, 22 thus made are opposed to each other with display and address electrodes 26, 30 positioned to cross each other substantially at right angles and are put together by sealing their periphery with the sealing member. Thereafter, the space partitioned by barrier ribs 32 is exhausted of gas and then filled with the discharge gas including Ne and Xe. A gas opening is finally sealed, thus completing the PDP having the structure such as illustrated by FIG. 1.

INDUSTRIAL APPLICABILITY

In the plasma display device of the present invention described above, the dielectric layer is constructed to have at least the two layers of different softening points. This dielectric layer is formed with, at its surface closer to the discharge space, the recessed part in each discharge cell, whereby the discharge can be controlled. Consequently, the efficiency and image quality can both be improved.

REFERENCE MARKS IN THE DRAWINGS

21 front panel
22 back panel
23, 29 substrates
24 scan electrode
25 sustain electrode
24*a*, 25*a* transparent electrodes
24*b*, 25*b* bus electrodes
26 display electrode
27, 27*a*, 27*b*, 31 dielectric layers
27*c* recessed part
28 protective layer
30 address electrode
32 barrier rib
33 phosphor layer

The invention claimed is:

1. A plasma display device comprising:

a front substrate;

a back substrate opposed to said front substrate so as to form a discharge space between said front substrate and said back substrate;

a plurality of barrier ribs provided in said discharge space so as to partition said discharge space;

a plurality of display electrodes including transparent electrodes and bus electrodes disposed on said front substrate so as to form a plurality of discharge cells between said barrier ribs;

a dielectric layer disposed above said front substrate; and a phosphor layer which emits light by discharge between said display electrodes, wherein said dielectric layer is constructed of a lower layer and an upper layer, wherein said lower layer of said dielectric layer is disposed on said front substrate so as to cover said display electrodes, wherein said upper layer of said dielectric layer is disposed so as to cover said lower layer of said dielectric layer, and is disposed so as to be closer to said discharge space than said lower layer of said dielectric layer, wherein said lower layer of said dielectric layer has a higher dielectric constant than said upper layer of said dielectric layer, wherein said lower layer of said dielectric layer has a higher softening point than said upper layer of said dielectric layer, wherein said upper layer of said dielectric layer, in each of said discharge cells, includes a recessed part located inside of said bus electrodes of said discharge cell and inside of said barrier ribs, and a surface of said lower layer of said dielectric layer is exposed through said recessed parts to said discharge space, wherein, in each of said discharge cells, said recessed part is disposed so as to at least partially overlap said transparent electrodes, and said recessed part is disposed at a position at least 20 μm away from said barrier ribs, and wherein, in each of said discharge cells, a discharge is limited to a bottom portion of said recessed part.

2. The plasma display device of claim 1, wherein said dielectric layer includes glass powder selected from a mixture including $ZnO—B_2O_3—SiO_2$, a mixture including $PbO—B_2O_{3—SiO2}$, a mixture including $PbO—B_2O_3—SiO_2—Al_2O_3$, a mixture including $PbO—ZnO—B_2O_3—SiO_2$ and a mixture including $Bi_2O_3—B_2O_3—SiO_2$, and wherein said glass powder is formed as a sheet.

3. The plasma display device of claim 1, wherein, in each of said discharge cells, said recessed part is formed such that a bottom portion of said recessed part has a smaller width than a top portion of said recessed part, said top portion of said recessed part being closer to said discharge space than said bottom portion of said recessed part.

4. The plasma display device of claim 1, wherein each of said discharge cells includes only one recessed part.

5. The plasma display device of claim 1, wherein, in each of said discharge cells, said recessed part is formed such that both of a top portion of said recessed part and said bottom portion of said recessed part at least partially overlap said transparent electrodes, said top portion of said recessed part being closer to said discharge space than said bottom portion of said recessed part.

6. The plasma display device of claim 1, wherein, in each of said discharge cells, said recessed part is formed such that said bottom portion of said recessed part has a smaller width than a top portion of said recessed part, said top portion of said recessed part being closer to said discharge space than said bottom portion of said recessed part, and such that both of said top portion and said bottom portion of said recessed part at least partially overlap said transparent electrodes.

* * * * *